US009568219B2

(12) United States Patent
Kuehl et al.

(10) Patent No.: US 9,568,219 B2
(45) **Date of Patent: *Feb. 14, 2017**

(54) HIGH EFFICIENCY REFRIGERATOR

(71) Applicant: Whirlpool Corporation, Benton Harbor, MI (US)

(72) Inventors: Steven John Kuehl, Stevensville, MI (US); Guolian Wu, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 120 days.

This patent is subject to a terminal disclaimer.

(21) Appl. No.: 13/948,282

(22) Filed: Jul. 23, 2013

(65) Prior Publication Data

US 2013/0305772 A1 Nov. 21, 2013

Related U.S. Application Data

(63) Continuation of application No. 12/503,325, filed on Jul. 15, 2009, now Pat. No. 8,511,109.

(51) Int. Cl.

| | |
|---|---|
| ***F25B 5/04*** | (2006.01) |
| ***F25B 1/00*** | (2006.01) |
| ***F25D 16/00*** | (2006.01) |
| ***F25B 5/02*** | (2006.01) |
| ***F25B 40/02*** | (2006.01) |
| ***F25D 11/02*** | (2006.01) |
| ***F25D 13/04*** | (2006.01) |

(52) U.S. Cl.

CPC . *F25B 1/00* (2013.01); *F25B 5/02* (2013.01); *F25B 40/02* (2013.01); *F25D 11/025* (2013.01); *F25D 13/04* (2013.01); *F25D 16/00* (2013.01); *F25B 2309/001* (2013.01); *F25B 2400/052* (2013.01); *F25B 2400/24* (2013.01); *F25B 2600/2511* (2013.01)

(58) Field of Classification Search

CPC ..... F25D 16/00; F25D 11/025; F25D 11/006; F25D 11/022; F25B 2400/24; F25B 2600/2511; F25B 40/02; F25B 1/00; F25B 5/04; F24F 5/0017; Y02B 30/123; Y02E 60/147

See application file for complete search history.

(56) References Cited

U.S. PATENT DOCUMENTS 2,641,109 A * 6/1953 Muffly ..... F25D 11/006 62/135
2,726,067 A * 12/1955 Wetherbee ..... F24F 3/001 165/104.31
4,373,346 A * 2/1983 Hebert ..... F25B 29/003 62/160

(Continued)

*Primary Examiner* — Frantz Jules
*Assistant Examiner* — Martha Tadesse

(57) ABSTRACT

A thermal storage container is coupled to a pump for circulating cooled liquid from the thermal storage container in at least one of two circuits. One circuit includes a heat exchanger coupled to the fresh food evaporator for assisting in cooling the fresh food section of the refrigerator or for chilling the liquid. Another circuit includes a sub-cooler between the condenser and the evaporator for cooling the output from the condenser before entering the evaporator, hereby increasing the efficiency of the system. A three-way valve is coupled from the output pump to couple the stored coolant selectively to one or the other or both of the coolant circuits.

14 Claims, 4 Drawing Sheets

(56) References Cited

U.S. PATENT DOCUMENTS

| | | | | | |
|---|---|---|---|---|---|
| 4,964,279 | A * | 10/1990 | Osborne | F25D 16/00 | 62/201 |
| 5,251,455 | A * | 10/1993 | Cur | F25B 5/02 | 62/199 |
| 5,307,642 | A * | 5/1994 | Dean | F24F 5/0017 | 62/201 |
| 5,386,709 | A * | 2/1995 | Aaron | F25B 5/02 | 62/199 |
| 5,647,225 | A * | 7/1997 | Fischer | F24F 5/0017 | 62/434 |
| 5,755,104 | A * | 5/1998 | Rafalovich | F25B 13/00 | 62/205 |
| 6,332,335 | B1 * | 12/2001 | Kajimoto | F25B 5/02 | 62/270 |
| 6,427,463 | B1 * | 8/2002 | James | F25B 5/04 | 62/186 |
| 6,460,355 | B1 * | 10/2002 | Trieskey | F25B 5/02 | 62/175 |
| 8,181,470 | B2 * | 5/2012 | Narayanamurthy | F25D 16/00 | 62/113 |
| 8,281,608 | B2 | 10/2012 | Kuehl et al. | | |
| 8,453,476 | B2 | 6/2013 | Kendall et al. | | |
| 2001/0015076 | A1 * | 8/2001 | Schulak | F24D 11/0214 | 62/440 |
| 2006/0110259 | A1 * | 5/2006 | Puff | F04B 35/045 | 417/44.2 |
| 2008/0034760 | A1 * | 2/2008 | Narayanamurthy | F24F 5/0017 | 62/59 |
| 2008/0141699 | A1 * | 6/2008 | Rafalovich | F25C 1/24 | 62/340 |
| 2008/0156009 | A1 * | 7/2008 | Cur | F25D 11/02 | 62/185 |
| 2010/0293987 | A1 | 11/2010 | Horst et al. | | |

* cited by examiner

| | Refrigerator Mode | Single Speed or Variable Capacity Compressor 40 (VCC) | Thermal Storage System Cooling Potential State | FC By-Pass Valve 46 | Pump 80 | 3-Way Valve Setting 90 | Check Valve (Passive) 52 | Fresh Food Throttle Valve (Passive) 47 | Thermal Storage System Operational Mode |
|---|---|---|---|---|---|---|---|---|---|
| 200 | freezer operation, low or normal system load conditions | on (low if vcc) | low-high | set to Freezer Compartment | off | closed to all | open | standby | Thermal storage system at standby, passively cools Fresh Food compartment if contained within the compartment. |
| 202 | fresh food operation, normal system load conditions | on (med-high if vcc) | low-med | set to Fresh Food Compartment | on | open to thermal storage generation | closed | active | Banks up thermal capacity during Fresh Food evaporator circuit operation mode for use at later time to cool fresh food. If compressor off then provides cooling or potential defrosting to fresh food evaporator. |
| 204 | freezer operation, high system load conditions | on (high if vcc) | low-high | set to Freezer Compartment | on | open to pre-cooler | open | standby | Pre-cooling of compressor discharge lowers condensing pressure and increases available cooling capacity for Freezer Evaporator. |
| 206 | fresh food operation, high system load conditions | on (med-high if vcc) | low-high | set to Fresh Food Compartment | on | open to thermal storage generation | closed | active | Banks up thermal capacity during Fresh Food evaporator circuit operation mode for use at later time to cool fresh food. If compressor off then provides cooling or potential defrosting to fresh food evaporator. |

FIG. 3A

| | Refrigerator Mode | Single Speed or Variable Capacity Compressor 40 (VCC) | Thermal Storage System Cooling Potential State | FC By-Pass Valve 46 | Thermal Storage System Pump 80 | 3-Way Valve Setting 90 | Check Valve (Passive) 52 | Fresh Food Throttle Valve (Passive) 47 | Thermal Storage System Operational Mode |
|---|---|---|---|---|---|---|---|---|---|
| 208 | fresh food operation, low system load conditions | off | med-high | set to Fresh Food Compartment | on | open to thermal storage generation | closed | standby | Uses banked thermal capacity during Fresh Food cooling defrosting to fresh food evaporator. |
| 210 | freezer operation, low or normal system load conditions | on (low if vcc) | low-high | set to Freezer Compartment | off | closed to all | open | standby | Thermal storage system at standby, passively cools Fresh Food compartment if contained within. |
| 212 | freezer & fresh food operation, low -normal system load conditions | on (low if vcc) | med-high | set to Freezer Compartment | on | open to thermal storage generation | open | standby | Uses banked thermal capacity to cool Fresh Food compartment. |
| 214 | freezer & fresh food operation, med-high system load conditions | on | med-high | set to Freezer Compartment | on | open to both circulation loops | open | standby | Uses banked thermal capacity to cool Fresh Food compartment and pre-cool compressor discharge |

FIG. 3B

HIGH EFFICIENCY REFRIGERATOR

CROSS-REFERENCE TO RELATED APPLICATIONS

This application is a Continuation application of U.S. Ser. No. 12/503,325 filed Jul. 15, 2009, which is herein incorporated by reference in its entirety.

BACKGROUND OF THE INVENTION

The present invention relates to a refrigerator including a freezer compartment and fresh food refrigeration compartment and particularly a thermal storage system for maximizing the efficiency of operation of the refrigerator.

Refrigerators typically cycle on and off depending upon the frequency of use, the content, and the surrounding environmental conditions. With conventional refrigerators, the refrigerator compressor runs at maximum capacity regardless of load demands. This results in the utilization of a significant amount of energy, which is environmentally wasteful and expensive for the consumer. Linear compressors, such as disclosed in U.S. Patent Publication 2006/00110259, the disclosure of which is incorporated herein by reference, are capable of a variable operating capacity ranging in the neighborhood of a ratio of 5:1. Linear compressors, thus, can be controlled to meet the actual demand for refrigerators but also have the benefit of begin capable of a higher operating capacity than conventional rotary compressors. Additionally, it is well known in the art that lowering condensing temperature increases efficiency of a refrigerant compressor, however, for the linear compressor disclosed in the referenced U.S. Patent Publication 2006/00110259, the capacity to compression work ratio can be amplified beyond that of a reciprocating compressor, thus providing a further favorable energy efficient operational condition.

SUMMARY OF THE INVENTION

In order to draw upon the benefits of the variable and higher capacity available with a linear compressor, the thermal storage system of the present invention stores thermal energy (i.e., a coolant) in a thermal storage unit with the compressor operating at a higher capacity during low load conditions. Under high demand situations, the stored coolant can be circulated in a heat exchanger for cooling the fresh food refrigerator compartment or be coupled in a circulation circuit to sub-cool the output of the condenser, lowering the condensing pressure of the refrigeration system and, thus, increasing the cooling capacity output of the compressor and offsetting the need to size the compressor and condenser for highest estimated demand based solely on condenser heat transfer limitations within a given ambient air temperature condition. Also, the stored coolant can simultaneously flow through both circulation circuits. In either mode, the operating efficiency of the refrigerator is improved by taking advantage of the capacity of the linear compressor in providing coolant which can be stored when the full capacity of the compressor is not needed for normal refrigerator operation.

The system of the present invention, therefore, provides a thermal storage unit coupled to a pump for circulating cooled heat transfer liquid from the thermal storage unit in at least one of two possible circuits. One circuit includes a heat exchanger coupled to the fresh food evaporator for either assisting in cooling the fresh food section of the refrigerator, for cooling the heat transfer liquid, or defrosting the fresh food evaporator. Another circuit includes a sub-cooler after the condenser for cooling the refrigerant output from the condenser to below ambient temperatures before entering the expansion device, thereby increasing the efficiency of the system.

In a preferred embodiment of the invention, a three-way valve is coupled from the output pump to couple the stored coolant selectively to one or the other or both of the coolant circuits. In another preferred embodiment of the invention, the thermal storage unit comprises a thermal storage tank for water or a water/alcohol mix or other secondary coolant typically used in a refrigeration system. Although the system is most efficient when used with a linear compressor having sufficient capacity to cool the liquid coolant for storage in the insulated thermal storage tank, it can also be used with a conventional rotary compressor to even out the demand on the compressor.

Thus, with the system of the present invention, the capacity available from a compressor can be employed during low demand situations to store thermal energy for use under high demand conditions to more efficiently operate the refrigeration system.

These and other features, objects and advantages of the present invention will become apparent to those skilled in the art upon reading the following description thereof together with reference to the accompanying drawings.

BRIEF DESCRIPTION OF THE DRAWINGS

FIGS. 3A and 3B are a table illustrating the various modes of operation of the refrigerator and the thermal storage system of the present invention.

DETAILED DESCRIPTION OF THE PREFERRED EMBODIMENT

Figure 1:
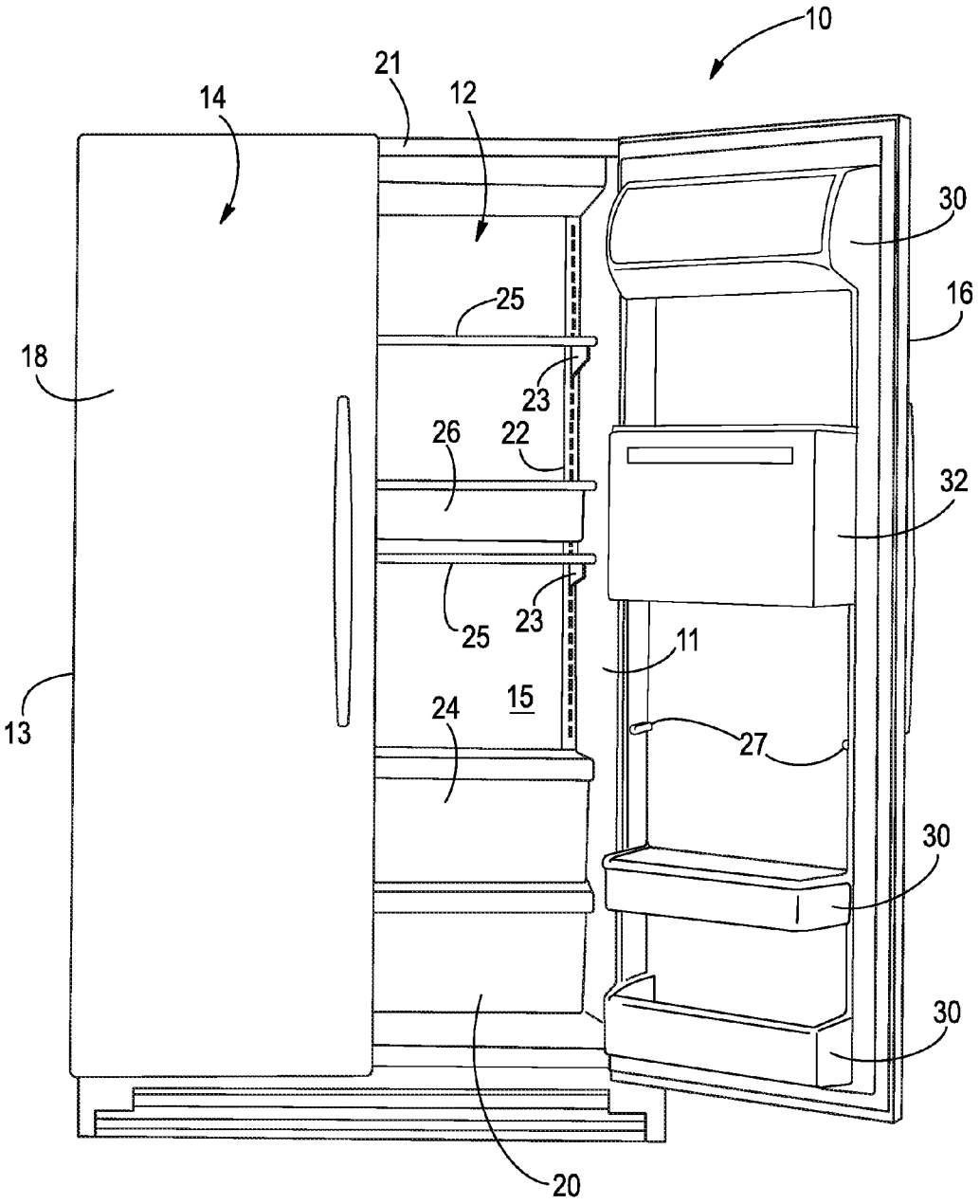
FIG. 1 is a perspective view of a side-by-side refrigerator freezer incorporating the thermal storage system of the present invention.

Referring initially to FIG. 1, there is shown a refrigerator freezer 10 embodying the present invention, which includes a side-by-side refrigerated cabinet 12 and a freezer cabinet 14. Each of the cabinets 12 and 14 include side walls 11 and 13, respectively, and a rear wall 15. Refrigerator 10 also includes a closure door 16 for the refrigerator cabinet 12 which is hinged to cabinet 12 and a freezer door 18 hinged to the freezer cabinet 14. Both doors 16 and 18 include suitable seals for providing an airtight thermally insulated sealed connection between the doors and respective cabinets. Although a side-by-side refrigerator/freezer is illustrated in FIG. 1, the present invention can be employed with any configuration of a refrigerator/freezer combination.

Refrigerator 10 is adapted to receive a variety of shelves and modules at different positions defined by, in the embodiment shown in FIG. 1, a plurality of horizontally spaced vertical rails 22 extending from the rear wall of the refrigerator and freezer compartments. In the embodiment shown, the supports are in the form of vertically extending rails with vertically spaced slots for receiving mounting tabs on shelf supports 23 and similar tabs on modules, such as modules 20, 24, 25, and 26, for attaching them in cantilevered fashion to the cabinets at selected incrementally located positions. The inside edges of doors 16 and 18 also include vertically spaced shelf supports, such as 27, for positioning bins 30 and modules, such as 32, in the doors. The shelves, modules, and bins and, thus, be located at a variety of selected locations within the cabinets 12 and 14 and doors 16 and 18 to allow the consumer to select different locations for convenience of use.

Some of the modules in refrigerator 10, such as module 20, may require operating utilities. Thus, module 20 may be a powered crisper or an instant thaw or chill module and may require utilities, such as cooled or heated fluids or electrical operating power. Other modules, such as module 26, may likewise require operational utilities while modules, such as a passive crisper module 20, would not. Door modules also, such as module 32, may, for example, include a water dispenser, vacuum bag sealer or other accessory conveniently accessible either from the outside of door 16 or from within the door and likewise may receive operating utilities from conduits, such as disclosed in application Ser. No. 12/469,915, filed May 21, 2009, and entitled Refrigerator Module Mounting System; Ser. No. 12/469,968 filed May 21, 2009, and entitled Multiple Utility Ribbon Cable; and Ser. No. 12/493,524 filed Jun. 29, 2009 and entitled Tubular Conduit. The disclosures of these patent applications are incorporated herein by reference.

Contained within the insulated cabinets of the refrigerator are the usual freezer and fresh food evaporator, condenser, and the usual fluid couplings to a compressor for the operation of the refrigerator. Refrigerator 10 of this invention, however, includes the additional fluid circuits and thermal storage system as shown in the schematic diagram of FIG. 2, now described.

Figure 2:
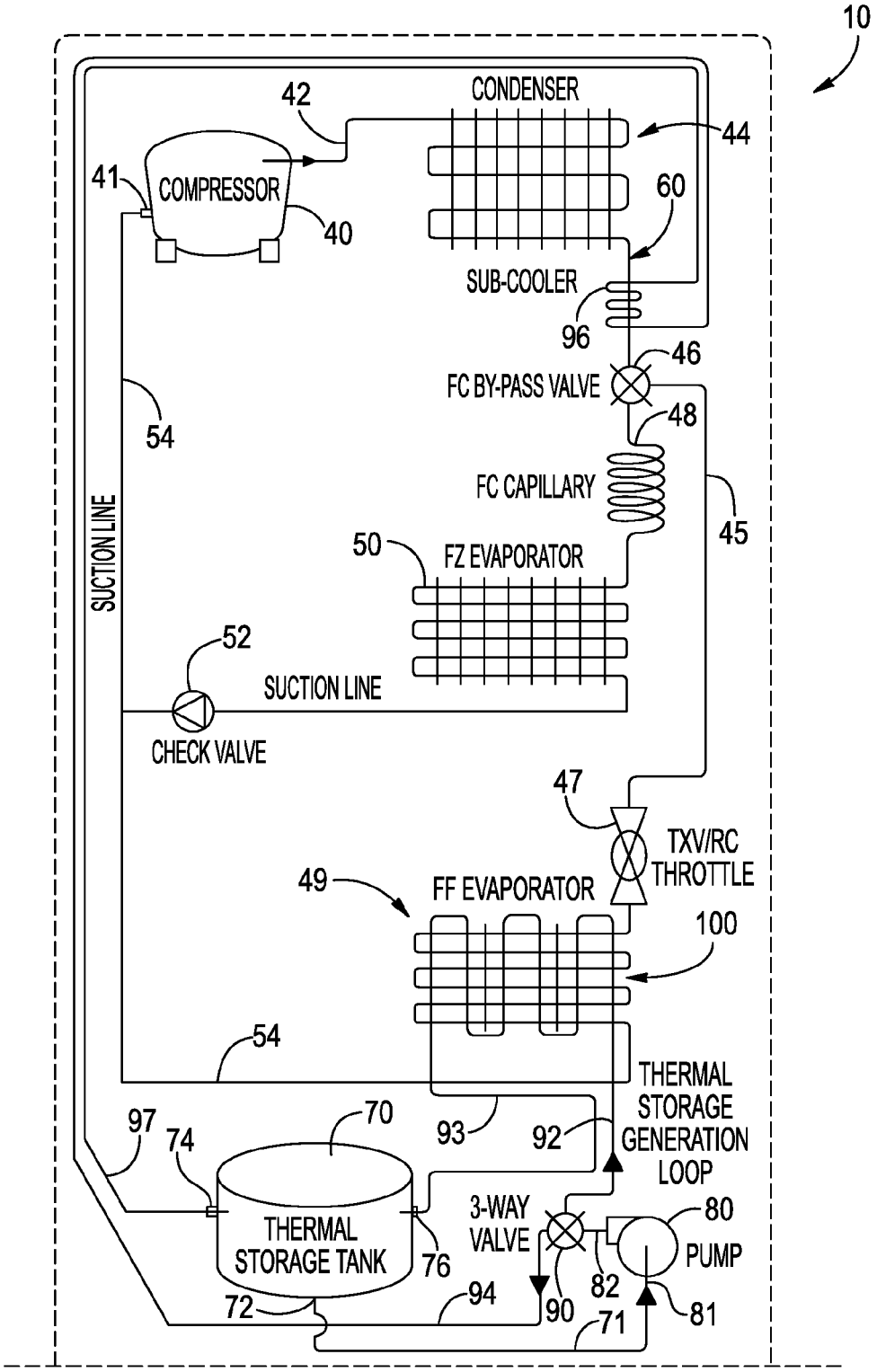
FIG. 2 is a schematic view of the components of the thermal storage system of the present invention.

The schematic diagram of FIG. 2 shows the locations of various major components of the refrigerator and thermal storage system in no particular relationship within the refrigerator cabinet, it being understood that, in practice, these elements can be located in any conventional or convenient location. For example, the condenser may conventionally be located in the back outside wall of the cabinet or in a compartment above cabinets 12, 14. Thus, the schematic diagram of FIG. 2 is illustrative only and does not necessarily limit the position of any of the components.

In FIG. 2, the heart of the refrigerator 10 is a linear compressor 40 which, due to its relatively flat elongated shape, can be located conveniently at nearly any location within the refrigerator, including in the space between the refrigerator inner liner and its outer shell. Frequently, the compressor is located near the top of the refrigerator near the condenser where heat can be evacuated upwardly and away from the refrigerator cabinet. The compressor 40 can be of the type described in U.S. patent application Ser. No. 10/553,944 filed Apr. 22, 2004, entitled System for Adjusting Resonant Frequencies in a Linear Compressor and published as Publication No. 2006/0110259 on May 25, 2006. The disclosure of this application and publication are incorporated herein by reference. Compressor 40 is coupled to a refrigeration circuit 60 including conduit 42 which couples the compressor to a condenser 44 and then to a two-way bypass valve 46. The bypass valve 46 is selectively operated to either direct the refrigerant flow through a freezer compartment capillary 48 and into the freezer compartment evaporator 50 or via conduit 45 to the fresh food evaporator 49 through a thermostatic expansion valve 47 or other expansion device. When in a position to direct refrigerant to the freezer evaporator 50, a check valve 52 is open to the suction line 54 leading to the input 41 of the compressor. With the valve 46 in the freezer compartment bypass position, the refrigerant flows through conduit 45 into a thermostatic expansion valve 47, into the fresh food evaporator 49, and then into the suction line 54 again leading to the input 41 of compressor 40. Bypass valve 46 is selectively operated by a microprocessor-based control circuit to either allow the flow of refrigerant through the freezer evaporator 50 or, alternatively, through the fresh food evaporator 49 depending upon the thermal demand of the compartments 14, 12, respectively. Though not illustrated thusly, suction line 54 typically is in thermal communication with freezer capillary 48 or fresh food expansion device 47 for operational efficiency. The components of the refrigeration system described thus far are typical components in a normal refrigeration system in which a microprocessor-based control circuit with suitable temperature sensors is employed and can be of a generally conventional design.

In addition to the coolant circuit for the freezer evaporator 50 and the fresh food evaporator 49 described, the system of the present invention adds parallel flow paths or first and second coolant circuits for circulating a chilled liquid from a thermal storage tank 70. Tank 70 is a thermally insulated tank and can be placed in the fresh food compartment or otherwise located in the machine compartment section of a given refrigerator/freezer configuration. Tank 70 typically is blow molded of a suitable polymeric material, such as PVC or polyethylene, and insulated by a jacket. It could be a Dewar flask or thermos vacuum bottle type tank using metal plated polymers as chrome plates onto ABS and other polymers very well to provide a highly reflective surface. The size of tank 70 depends on the intended application. If the stored thermal mass is strictly for a single refrigerator, then it may have a capacity of 1 to 4 liters for holding approximately 0.75 to 3 kgs of, for example, a water/alcohol solution. If a secondary circuit for supplemental devices, such as counter top devices or the like, are coupled to refrigerator 10, tank 70 could be two to three times larger. The tank includes an output connection 72 and two input connections 74 and 76 for circulating stored liquid coolant through two separate circuits either to chill the coolant or to transfer heat from the refrigerator components to the chilled coolant.

Output connection 72 is coupled by conduit 71 to the input 81 of liquid pump 80 having an output 82 coupled to a three-way valve 90. Valve 90 has three positions which can direct fluid from output 82 of pump 80 to a first conduit 92, a second conduit 94, or to both conduits simultaneously depending upon the position of the three-way valve 90. In one position, only conduit 92 is coupled to the output of pump 80 and couples the chilled fluid from tank 70 to a first circuit including a secondary heat exchanger 100 in thermal communication with fresh food evaporator 49. The secondary heat exchanger is coupled by a return conduit 93 to input 76 of thermal storage tank 70 to complete the first circulation circuit.

A second circulation circuit includes conduit 94 coupled to valve 90 and coupled to a sub-cooler 96 surrounding the conduit 60 between the condenser 44 and bypass valve 46 to sub-cool the typically warm refrigerant liquid from the condenser before it enters an expansion device. A return conduit 97 from sub-cooler 96 leads back to the input 74 of thermal storage tank 70. Finally, in a third position of valve 90, the chilled coolant in thermal storage tank 70 is simultaneously circulated through both the first circulation circuit including the secondary heat exchanger 100 and the second circulation circuit including the sub-cooler 96.

The coolant employed for the thermal storage tank 70 and circulated by pump 80 can be one of a number of conventional coolants employed in the refrigeration industry, such as water, a water/alcohol mixture, brine, or a Dynalene® heat transfer fluid. The thermal storage tank, once filled through a suitable opening which is subsequently sealed after the circulation circuits through the sub-cooler 96 and secondary heat exchanger 100 have been purged of air, provides sealed liquid circuits or loops for the chilled thermal medium being pumped by pump 80.

The coolant in the thermal storage tank is chilled by the secondary heat exchanger 100 when the compressor 40 is in operation to provide cooling to the fresh food evaporator 49 under conditions where excess capacity from the compressor is available. Thus, when valve 46 is moved to a position to supply refrigerant through line 45 and throttle valve 47 to the fresh food evaporator 49 (unless under a high load condition for the refrigeration cabinet 12), the excess cooling available is employed by heat exchanger 100 to chill the thermal media circulated by pump 80 through the first circulation circuit, including conduit 71, pump inlet 81, valve 90, conduit 92, heat exchanger 100, and conduit 93, back to tank 70 to chill the liquid coolant. The overall operation of the system during different modes of operation is best seen by the chart of FIGS. 3A and 3B, which shows the status of the valves, the compressor, and the thermal storage pump during different scenarios of operation.

In line 200, the refrigeration mode is in the freezer operation under low or normal load conditions. In this mode of operation, compressor 40 is on and can be in low capacity operation if a variable capacity compressor, such as a linear compressor, is employed. The potential temperature of the liquid in the thermal storage tank is at standby and may be, if located within the fresh food compartment 12, somewhat cooled. The bypass valve 46 is off to allow the refrigerant to pass through the freezer evaporator 50 while the three-way valve 90 is turned off to close off both first and second circulation circuits. Check valve 52 is opened while the throttle valve 47 is on standby. In this mode, the thermal storage system is in the standby mode with no circulation of coolant through the tank 70.

In the second mode of operation indicated at line 202, the fresh food compartment 12 is in operation with the compressor on medium to high capacity and the thermal storage tank 70 in either a low or medium cooling state. The bypass valve 46 is set to circulate refrigerant through line 45 through valve 47 to provide coolant to the fresh food evaporator 49. At the same time, pump 80 is activated with valve 90 turned on to circulate the coolant through the first circuit, including line 71, pump 80, line 82, valve 90, line 92 through secondary heat exchanger 100 and returning to tank 70 through line 93 and input 76. In this position, check valve 52 is closed, while the throttle valve 47 is open. During this interval of operation, the coolant is chilled by thermal communication between heat exchanger 100 and evaporator 49. Thus, the thermal storage tank 70 banks thermal capacity during the evaporator 49 operation for use at a later time to cool fresh food. If compressor 40 is off, then the secondary heat exchanger 100 can provide cooling to the fresh food compartment 12 or potentially defrost the fresh food evaporator 49.

In line 204, the mode of operation is the freezer in operation under high load conditions. Compressor 40 is operating at its maximum capacity, while the coolant in the thermal storage tank can be anywhere from a low to a high cooling potential level. In this condition, the bypass valve 46 is set to direct refrigerant to the freezer evaporator 50 and the thermal storage pump is on with the valve 90 open to the sub-cooler 96 to allow the coolant from tank 70 to be pumped through line 94 through the sub-cooler 96 and return via line 97 to the storage tank 70. In this position, the throttle valve 47 is in a standby mode and the chilled liquid in thermal storage tank 70 is employed for sub-cooling the compressor discharge, which lowers the condensing pressure and increases the availability of cooling for the freezer evaporator capacity. During this mode, the stored thermal energy (in the form of cooling ability) and the thermal storage tank 70 is used to reduce the temperature of the refrigerant exiting the condenser, thereby improving the efficiency of the system and increasing system capacity beyond that obtainable by solely rejecting heat to the ambient air via the condenser.

In the next mode of operation shown on line 206, fresh food evaporator 49 is being operated with the bypass valve 46 set to the fresh food compartment and the linear compressor is in a medium to high operational mode and a potential state of thermal state of thermal storage tank can be anywhere from low to high in terms of capacity to provide additional cooling. The storage pump 80 is turned on and the three-way valve setting 90 is open to circulate the coolant through the secondary heat exchanger 100. In this condition where the fresh food evaporator is operative in the refrigerant circuit, the throttle valve 47 is open. In this mode, the system banks whatever thermal capacity during fresh food evaporator circuit operation is available and, in the event the compressor 40 is turned off, the circulation of coolant from tank 70 through secondary heat exchanger 100 provides cooling or potential defrosting to the fresh food evaporator and to the fresh food storage compartment 12.

In the next mode of operation represented by line 208 (FIG. 3B), again the fresh food evaporator is in an operational mode, however, under low load conditions. The compressor 40 is off in this position, and the thermal storage media is in a medium to high potential cooling state. The bypass valve 46 is set to the fresh food compartment and the circulation pump 80 is turned on with the valve 90 open to the first circulation circuit as in the prior mode of operation. The fresh food throttle valve 47 is in standby state inasmuch as the compressor is now off. In this mode, as indicated in the last column of the chart, the bank of thermal capacity in terms of cooling ability is employed for fresh food cooling of compartment 12 or defrosting of the fresh food evaporator 49.

In the next mode of operation, the freezer is being operated, as shown by line 210, with the compressor 40 on and in a low capacity mode if it is a variable capacity compressor, such as the linear compressor of the preferred embodiment of the invention. In this condition, the freezer load is low or normal and the bypass valve 46 is set to direct refrigerant through the freezer evaporator 50. The three-way valve 90 is closed, and pump 80 is off. Check valve 52 is open to allow the refrigerant to circulate back through the compressor through suction line 54 and the throttle valve 47 is in standby mode. In this mode of operation, thermal storage tank 70 is inactive, however, if it is positioned within the fresh food compartment, it will potentially provide some cooling to the fresh food compartment while in a standby mode depending on the temperature of the stored thermal mass.

Next, as indicated by line 212, again, the compressor 40 is on in a low capacity mode of operation and the bypass valve 46 is set to the freezer compartment. In this mode of operation, the freezer and fresh food compartments are in low or normal system load conditions. The thermal storage system pump 80 is turned on, while the three-way valve 90 is open to the first circulation circuit, including secondary heat exchanger 100. Check valve 52 is open, while the throttle valve 47 is in a standby mode. In this mode also, the available coolant from the liquid coolant in storage tank 70 is used to cool the fresh food compartment while the refrigerant in a normal circulation circuit for refrigerant is being employed in the freezer compartment through the freezer evaporator 50.

Finally, with valve 90 open to both circulation circuits, the chilled fluid from tank 70 is circulated through both the secondary heat exchanger 100 to cool the fresh food compartment 12 and sub-cool the compressor output through sub-cooler 96. This operation is represented by line 214 in the table of FIG. 3B.

Thus, in the various modes of operation, the excess thermal capacity of the compressor is employed for storing thermal energy in the form of cooling the liquid coolant in thermal storage tank 70, which can be subsequently used in either the first circulation circuit for either cooling to the liquid cooling medium when the refrigerant from compressor 40 is being applied to the fresh food evaporator 49 or for providing cooling to the fresh food compartment when the bypass valve 46 is in the freezer position. Alternately, when there is no need for coolant in the liquid storage tank to be additionally cooled, it can be employed for sub-cooling the output of condenser 44, thereby increasing the efficiency of the system in operation when either the freezer compartment or fresh food compartment or external supported thermal load (as disclosed in application Ser. No. 12/469,915, filed May 21, 2009, and entitled Refrigerator Module Mounting System; Ser. No. 12/469,968 filed May 21, 2009, and entitled Multiple Utility Ribbon Cable; and Ser. No. 12/493,524 filed Jun. 29, 2009 and entitled Tubular Conduit) is under high load conditions.

The operational states of the valves are controlled by an electrical control system which is programmed according to the settings set forth in the table of FIGS. 3A and 3B in a conventional manner to achieve the desired switching of the valve positions and the operation of pump 80 in coordination with the control circuit for compressor 40. Thus, with the system of the present invention, the capacity available from the compressor and, particularly, as in the preferred embodiment, a linear compressor with greater capacity and flexibility is employed, can be used to more efficiently operate the refrigeration system and even out the demand on both the compressor and other refrigeration components.

It will become apparent to those skilled in the art that various modifications to the preferred embodiments of the invention as described herein can be made without departing from the spirit or scope of the invention as defined by the appended claims.

The invention claimed is:

1. A cooling system for use within a refrigerator or freezer appliance, the cooling system comprising;

a primary cooling loop;

a compressor for a refrigerant;

a condenser coupled to said compressor;

a first evaporator coupled to said condenser;

a secondary cooling loop comprising;

a bypass valve between the condenser and the first evaporator;

a container for holding a liquid thermal mass disposed within a cabinet;

a sub-cooler thermally coupled between the bypass valve and the condenser;

a second evaporator in communication with the bypass valve and the container;

a secondary heat exchanger in thermal communication with said second evaporator;

conduits coupling said container in fluid communication with said secondary heat exchanger for the transmission of said liquid thermal mass;

a pump coupled to said conduits for circulating said liquid thermal mass from said container to said secondary heat exchanger; and a multi-way valve in communication with the secondary heat exchanger, the pump and the sub-cooler;

wherein in one position of the multi-way valve a first circuit is created between the secondary heat exchanger and the container, and in a second position of the multi-way valve a second circuit is created between the container and the sub-cooler; and wherein the container is in direct communication with the sub-cooler through the pump and the multi-way valve.

2. The primary cooling system as defined in claim 1 wherein the multi-way valve, in a third position permits fluid flow through both the first and second circuits at the same time.

3. The primary cooling system as defined in claim 2 wherein said compressor is a linear compressor.

4. The primary cooling system as defined in claim 3 wherein said second evaporator is positioned in a refrigerator compartment of a refrigerator/freezer.

5. The primary cooling system as defined in claim 4 wherein said secondary heat exchanger comprises coils surrounding said second evaporator and coupled to said conduits.

6. The primary cooling system as defined in claim 1 wherein said thermal mass comprises one of water, a water-alcohol mixture, brine, and a Dynalene® heat transfer fluid.

7. A cooling system comprising;

a primary cooling loop system comprising;

a compressor for a refrigerant;

a condenser coupled to said compressor;

a first evaporator;

a bypass valve coupled between said first evaporator and said condenser; and a secondary cooling system comprising;

a sub-cooler thermally coupled between said condenser and said bypass valve;

a second evaporator coupled to said bypass valve;

a container configured to hold a liquid thermal mass disposed within a cabinet;

a secondary heat exchanger in thermal communication with said second evaporator;

conduits for coupling said container in fluid communication with said secondary heat exchanger and said sub-cooler for the transmission of said liquid thermal mass;

a pump coupled to said conduits for circulating said liquid thermal mass from said container to said sub-cooler and said secondary heat exchanger when said bypass valve is in a position to circulate refrigerant to said second evaporator; and a multi-way valve in communication with the secondary heat exchanger, the pump and the sub-cooler;

wherein in one position of the multi-way valve a first circuit is created between the secondary heat exchanger and the container and in a second position of the multi-way valve a second circuit is created between container and the sub-cooler; and wherein the container is in direct communication with the sub-cooler through the pump and the multi-way valve.

8. The primary cooling system as defined in claim 7 wherein said compressor is a linear compressor.

9. The primary cooling system as defined in claim 8 wherein said first evaporator is positioned in a freezer compartment of a refrigerator/freezer and second evaporator is positioned in a refrigerator compartment of a refrigerator/freezer.

10. The primary cooling system as defined in claim 9 wherein said secondary heat exchanger comprises coils surrounding said second evaporator and coupled to said conduits.

11. The primary cooling system as defined in claim 10 wherein said conduits form parallel flow paths including said thermal mass including said container, said secondary heat exchanger, and said sub-cooler; and wherein the multi-way valve permits simultaneous fluid flow through both the first and second circuits.

12. A cooling system for a refrigerator comprising:

a linear compressor for a refrigerant;

a condenser coupled to said compressor;

first evaporator coupled to said condenser;

a bypass valve coupled between said first evaporator and said condenser;

a sub-cooler thermally coupled between said condenser and said bypass valve;

a container for holding a liquid thermal mass disposed within a cabinet;

a secondary heat exchanger in thermal communication with said first evaporator;

a second evaporator in fluid communication with the bypass valve;

conduits for coupling said container in fluid communication with said secondary heat exchanger for the transmission of said liquid thermal mass, wherein said conduits form parallel flow paths including said thermal mass including said container, said secondary heat exchanger, and said sub-cooler;

a pump coupled to said conduits for circulating said liquid thermal mass from said container to said secondary heat exchanger; and a multi-way valve in communication with the secondary heat exchanger, the pump and the sub-cooler;

wherein in one position of the multi-way valve a first circuit is created between the secondary heat exchanger and the container and in a second position of the multi-way valve a second circuit is created between the container and the sub-cooler; and wherein the container is in direct communication with the sub-cooler through the pump and the multi-way valve.

13. The cooling system as defined in claim 12, wherein the multi-way valve in a third position permits fluid flow through both the first and second circuits at the same time.

14. The cooling system as defined in claim 13 wherein said second evaporator is positioned in a refrigerator compartment of a refrigerator/freezer and said secondary heat exchanger comprises coils surrounding said second evaporator and coupled to said conduits.

* * * * *